US010822704B2

(12) United States Patent
Sasamura et al.

(10) Patent No.: US 10,822,704 B2
(45) Date of Patent: Nov. 3, 2020

(54) ELECTROLESS PLATINUM PLATING BATH

(71) Applicant: C. Uyemura & Co., Ltd., Osaka-shi, Osaka (JP)

(72) Inventors: Tetsuya Sasamura, Hirakata (JP); Katsuhisa Tanabe, Hirakata (JP); Hiroki Okubo, Hirakata (JP); Tatsushi Someya, Hirakata (JP); Eriko Furuya, Hirakata (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 16/314,844

(22) PCT Filed: Apr. 27, 2017

(86) PCT No.: PCT/JP2017/016794
§ 371 (c)(1),
(2) Date: Jan. 2, 2019

(87) PCT Pub. No.: WO2018/008242
PCT Pub. Date: Jan. 11, 2018

(65) Prior Publication Data

US 2019/0309423 A1 Oct. 10, 2019

(30) Foreign Application Priority Data

Jul. 4, 2016 (JP) ..... 2016-132811

(51) Int. Cl.
*C23C 18/44* (2006.01)
*C23C 18/16* (2006.01)

(52) U.S. Cl.
CPC ..... *C23C 18/44* (2013.01); *C23C 18/1662* (2013.01)

(58) Field of Classification Search
None
See application file for complete search history.

(56) References Cited

U.S. PATENT DOCUMENTS

| | | | | |
|---|---|---|---|---|
| 3,816,344 | A * | 6/1974 | Shimizu | B01D 53/944 502/257 |
| 5,298,280 | A * | 3/1994 | Kaczur | C25B 9/08 427/125 |
| 6,676,919 | B1 | 1/2004 | Fischer et al. | |
| 2004/0013601 | A1 | 1/2004 | Butz et al. | |
| 2014/0030635 | A1* | 1/2014 | Nakada | C25D 5/50 429/516 |
| 2019/0345612 | A1* | 11/2019 | Tanabe | C23C 18/54 |
| 2020/0020660 | A1* | 1/2020 | Maekawa | H01L 24/17 |

FOREIGN PATENT DOCUMENTS

| | | | |
|---|---|---|---|
| CN | 1144620 | C | 4/2004 |
| JP | S48-056591 | A | 8/1973 |
| JP | S54-117329 | A | 9/1979 |
| JP | S59-001667 | A | 1/1984 |
| JP | 2016-089190 | A | 5/2016 |
| JP | 2016-089203 | A | 5/2016 |

OTHER PUBLICATIONS

English translation of the Written Opinion of the International Search Authority dated Jun. 20, 2017 for PCT/JP2017/016794; 5 pages.*
English translation of JPS 59/1667, Jan. 1984; 7 pages.*
English translation of JP 2016/089203, May 2016; 14 pages.*
English translation of JP 2016/089190, May 2016; 28 pages.*
International Search Report for PCT/JP2017/016794, dated Jun. 20, 2017, in 2 pages.

* cited by examiner

*Primary Examiner* — Helene Klemanski
(74) *Attorney, Agent, or Firm* — Knobbe, Martens, Olson & Bear, LLP

(57) ABSTRACT

An electroless platinum plating solution includes a soluble platinum compound, a complexing agent, a reducing agent, and a halide ion supplying agent, the reducing agent being formic acid.

7 Claims, No Drawings

ELECTROLESS PLATINUM PLATING BATH

CROSS-REFERENCE TO RELATED APPLICATIONS

This application is the U.S. National Phase under 35. U.S.C. § 371 of International Application PCT/JP2017/016794, filed Apr. 27, 2017, which claims priority to Japanese Patent Application No. 2016-132811, filed Jul. 4, 2016. The disclosures of the above-described applications are hereby incorporated by reference in their entirety.

TECHNICAL FIELD

The present disclosure relates to an electroless platinum plating bath solution and a method for manufacturing a platinum coating.

BACKGROUND ART

A platinum coating is quite chemically stable and is less likely to be oxidized, and in addition, is excellent in heat resistance and durability. Therefore, the coating is widely used for components, such as an ignition plug for an automobile, and an exhaust gas sensor for an automobile, which are exposed in a severe environment. Also, such a coating has an excellent conductance, and thus, is expected to be applied to electronic components.

An electroless platinum plating solution including hydrazine as a reducing agent has been considered as an electroless platinum plating solution for use in forming a platinum coating (for example, see Patent Documents 1 and 2).

CITATION LIST

Patent Documents

[Patent Document 1] Japanese Unexamined Patent Publication No. 2016-89190

[Patent Document 2] Japanese Unexamined Patent Publication No. 2016-89203

SUMMARY OF THE INVENTION

Technical Problem

However, the electroless platinum plating solution including hydrazine as a reducing agent is not sufficiently stable, which is a problem. Also, the plating solution needs to have a high pH in order to obtain a practical deposition rate. Therefore, e.g., a dry-film resist used for, e.g., a substrate is likely to be dissolved, and thus, such a plating solution has a difficulty in applying it to electric components.

The present disclosure attempts to provide an electroless platinum plating solution with high stability.

Solution to the Problem

One aspect of an electroless platinum plating solution of the present disclosure includes a soluble platinum compound, a complexing agent, a reducing agent, and a halide ion supplying agent, the reducing agent being formic acid.

In one aspect of the electroless platinum plating solution, the halide ion supplying agent may be included at a molar ratio of 10 or more with respect to platinum.

In one aspect of the electroless platinum plating solution, the halide ion supplying agent may be an alkali metal halide.

In one aspect of the electroless platinum plating solution, the electroless platinum plating solution may have a pH of 9 or less.

One aspect of a method for manufacturing a platinum coating according to the present disclosure manufacturing a platinum coating on a target by submerging the target into the electroless platinum plating solution of the present disclosure.

Advantages of the Invention

The present disclosure can provide an electroless platinum plating solution with high stability.

DESCRIPTION OF EMBODIMENTS

An electroless platinum plating bath solution according to an embodiment includes a soluble platinum compound, a complexing agent, a reducing agent, and a halide ion supplying agent, the reducing agent being formic acid. Using formic acid for the reducing agent allows for providing a stable plating solution, compared with the case where a typical reducing agent such as a hydrazine or a boron compound is used. Formic acid may be in the form of salts such as sodium salt and potassium salt.

Reduction is less likely to occur in a case where formic acid is used than in a case where, e.g., hydrazine is used. Thus, only replacing the hydrazine in the electroless platinum plating solution with formic acid hardly causes a deposition reaction. However, the electroless platinum plating solution of the embodiment includes the halide ion supplying agent. The halide ion supplying agent functions as a reaction promoting agent promoting the deposition reaction of platinum, and platinum can be deposited, sufficiently, even in a situation where formic acid is used for the reducing agent. Halide ions advantageously enhances the stability of the plating solution, and this can provide a more stable, electroless platinum plating solution.

The halide ion supplying agent may be a compound including halide ions. Examples of the halide ion supplying agent include alkali metal halides such as sodium chloride, potassium chloride, sodium iodide, potassium iodide, sodium bromide, and potassium bromide. Among others, sodium chloride and potassium chloride are preferable for ease of handling.

In order to promote the deposition reaction, a molar ratio of the addition of the halide ion supplying agent to the content of platinum in the solution is preferably 10 or more, or more preferably 15 or more, or still more preferably 20 or more. In order to reduce the effect of halogen on the appearance of the coating, the molar ratio of the addition of the halide ion supplying agent to the content of platinum in the solution is preferably 500 or less, or more preferably 400 or less.

Examples of the soluble platinum compound include typical platinum salts, such as dinitrodiammine platinum, chloroplatinate, tetraammine platinum salt, and hexaammine platinum salt. These metal compounds can be used alone or in combination of two or more thereof.

Regarding the addition of the soluble platinum compound, a concentration of platinum in the solution is preferably 0.1 g/L or more in order to improve the productivity. Also, it is preferably 3 g/L or less or more preferably 2 g/L or less to stabilize the plating solution.

Typical compounds can be used as the complexing agent. Examples of such compounds include aminocarboxylic acids and polycarboxylic acids. Examples of the aminocarboxylic acids include glycine, ethylene diamine tetraacetic acid (EDTA), triethylendiaminetetraacetic acid, glutamic acid, and aspartic acid. Examples of the polycarboxylic acids include malonic acid, maleic acid, succinic acid, citric acid, and malic acid. The aminocarboxylic acids and the polycarboxylic acids may be in the form of salts. These compounds can be used alone or in combination of two or more thereof.

The concentration of the complexing agent is preferably 2 g/L or more or more preferably 4 g/L or more to stabilize the plating solution. Also, it is preferably 50 g/L or less or more preferably 30 g/L or less in terms of economic efficiency.

The pH of the plating solution can be set appropriately as necessity. Unlike the case where a hydrazine or a boron compound is used as the reducing agent, the pH does not have to be high. The pH of the plating solution is preferably 3 or more in terms of stability of the plating solution. Also, the pH of the plating solution is preferably 9 or less in terms of deposition rate. In order to stabilize the solution and avoid posing a burden on the environment, the solution more preferably has a pH of about 6 to 8, i.e., is substantially neutral. In order to adjust the pH, an acid or alkali can be added as a pH adjuster. In addition, a component having a buffering action can be added as a buffer. The buffer can be selected appropriately according to the pH to be adjusted. If the solution is substantially neutral, sodium dihydrogenphosphate, potassium dihydrogenphosphate, or other components can be used for the buffer.

Other optional components included in the typical electroless platinum plating solution can also be added to the plating solution of the embodiment. The optional components may be added if necessary, and the solution does not have to include such components. In particular, the electroless platinum plating solution of the embodiment is sufficiently stable, and a stabilizer such as lead monoxide or thiols does not have to be added to the solution. However, it is possible to add such a stabilizer or other components.

The temperature at which the plating solution of the embodiment is used, the time during which the plating solution is plated, and other conditions may be selected according to a thickness of a catalytic coating to be required. The temperature at which the solution is used is preferably 10° C. or more, and preferably 95° C. or less. The plating time is preferably five seconds or more, and preferably 30 minutes or less.

The thickness of the platinum coating formed by the plating solution of the embodiment is not particularly limited. It is possible to form the platinum coating having a thickness according to the necessity. Using the plating solution of the embodiment can easily form the platinum coating having a thickness of approximately 0.001 μm to 0.5 μm.

A base material that is a target for plating is submerged into the plating solution of the embodiment, thereby forming a platinum coating. The base material for the platinum coating is not particularly limited. For example, the base material may be a printed wiring board mounting electric components thereon, a semiconductor element mounting substrate mounting a semiconductor element thereon, or a conductor circuit provided to electric components to be mounted. The pH of the electroless platinum plating solution of the embodiment can be substantially neutral. This can easily plate circuit boards including thereon a dry-film resist (DFR) that is likely to cause elution and deteriorate the plating solution under a high pH condition.

EXAMPLES

The present invention will now be described in detail using the following examples. The following examples are merely examples, and the present invention is not limited thereto.

<Base Material>

Ball grid array (BGA) substrate, manufactured by C.Uyemura & Co., Ltd., was used.

Prior to use of the base material, a base material was subject to degreasing, soft etching, acid rinse treatment, pre-dipping, and activation. The degreasing was performed at 50° C. for five minutes by using a commercially available cleaning liquid (ACL-007, manufactured by C.Uyemura & Co., Ltd). The soft etching was performed at 25° C. for one minute by using a solution containing 10 g/L sulfuric acid and 100 g/L sodium persulfate. The acid rinse treatment was performed at 25° C. for one minute by using a 50 g/L sulfuric acid solution. The pre-dipping was performed at 25° C. for one minute by using a 20 g/L sulfuric acid solution. The activation was performed at 30° C. for two minutes by using a commercially available, strong acid activator including palladium (MNK-4, manufactured by C.Uyemura & Co., Ltd).

<Measurement of Thickness of Coating>

The thickness of the plated coating formed in the base material was evaluated by an X-ray fluorescence measuring system (XDV-μ, manufactured by FISCHER INSTRUMENTS K.K.).

<Evaluation of Solution Stability>

After the plating solution was made up, the solution was left at 40° C. for 50 hours. Then, it was confirmed whether or not decomposition of the plating solution or deposition of platinum, which may be a symptom of the decomposition, was visually seen. When no decomposition and deposition were seen, the state was evaluated as A. When deposition of platinum was seen, the state was evaluated as B. When decomposition was seen, the state was evaluated as C.

<Evaluations of Disturbance by of Dry-Film Resist>

The deposition rate of the platinum of the plating solution to the BGA material after submergence of the dry-film resist (DFR) was compared with that prior to the submergence. The entire surface of a glass epoxy plate was coated with a solder resist to form a solder resist base material. 50% of the area of the solder resist base material was coated with a commercially available dry-film resist to form a submerged base material. The submerged base material was submerged into the plating solution, which was at 40° C., for eight hours such that the submergence was carried out at a solution loading of 5 $dm^2/L$, and its deposition rate prior to submergence was compared with that after submergence. The deposition rate was evaluated by the thickness of the coating that has been formed on the surface of the base material after submergence of the base material into the plating solution, which was at 40° C., for ten minutes. If the deposition rate after the submergence of the submerged base material decreased by less than 30% of the deposition rate prior to the submergence, the state was evaluated as A. If the deposition rate after the submergence decreased by 30% or more and less than 50% of the deposition rate prior to the submergence, the state was evaluated as B. If the deposition rate after the submergence decreased by 50% or more of the deposition rate prior to the submergence, the state was evaluated as C.

Example 1

The electroless platinum plating solution was prepared by dissolving, in water, potassium tetrachloroplatinate(II) ($K_2PtCl_4$) as a soluble platinum compound with a platinum concentration of 0.5 g/L, 10 g/L ethylene diamine tetraacetic acid (EDTA) as a complexing agent, 10 g/L potassium salt that is a potassium formate as a reducing agent, and 50 g/L potassium chloride (KCl) as a halide ion supplying agent. The molar ratio of the addition of the halide ion supplying agent to the content of platinum is about 260. As a buffer, 10 g/L potassium dihydrogenphosphate was added to the electroless platinum plating solution. Also, a pH adjuster was added to allow the solution to have a pH of 7. As the pH adjuster, sulfuric acid or potassium hydroxide was used according to the pH prior to the adjustment.

The obtained electroless platinum plating solution was evaluated in terms of solution stability and the disturbance by the dry-film resist. The evaluations of the solution stability and the disturbance by the dry-film resist were both A. The thickness of the platinum plated coating after the submergence of the submerged base material was 0.05 μm.

Example 2

Example 2 was the same as example 1 except that the concentration of KCl as the halide ion supplying agent was 5 g/L. The molar ratio of the addition of the halide ion supplying agent to the content of platinum was about 26. The evaluations of the solution stability and the disturbance by the dry-film resist were both A. The thickness of the platinum plated coating after the submergence of the submerged base material was 0.04 μm.

Example 3

Example 3 was the same as example 1 except that the pH was 4 by the pH adjuster. The evaluations of the solution stability and the disturbance by the dry-film resist were both A. The thickness of the platinum plated coating after the submergence of the submerged base material was 0.05 μm.

Example 4

Example 4 was the same as example 1 except that 50 g/L potassium iodide (KI) was added as a halide ion supplying agent. The molar ratio of the addition of the halide ion supplying agent to the content of platinum was about 120. The evaluations of the solution stability and the disturbance by the dry-film resist were both A. The thickness of the platinum plated coating after the submergence of the submerged base material was 0.05 μm.

Example 5

Example 5 was the same as example 1 except that 50 g/L potassium bromide (KBr) was added as a halide ion supplying agent. The molar ratio of the addition of the halide ion supplying agent to the content of platinum is about 160. The evaluations of the solution stability and the disturbance by the dry-film resist were both A. The thickness of the platinum plated coating after the submergence of the submerged base material was 0.05 μm.

Example 6

Example 6 was the same as example 1 except that tetraammine platinum(II) chloride ($Pt(NH_3)_4Cl_2$) was used as a soluble platinum compound with a platinum concentration of 0.5 g/L. The evaluations of the solution stability and the disturbance by the dry-film resist were both A. The thickness of the platinum plated coating after the submergence of the submerged base material was 0.05 μm.

Example 7

Example 7 was the same as example 1 except that tetraammine platinum(II) hydroxide ($Pt(NH_3)_4(OH)_2$) was used as a soluble platinum compound with a platinum concentration of 0.5 g/L. The evaluations of the solution stability and the disturbance by the dry-film resist were both A. The thickness of the platinum plated coating after the submergence of the submerged base material was 0.05 μm.

Example 8

Example 8 was the same as example 1 except that dinitrodiammine platinum (II) ($Pt(NO)_2(NH_3)_2$) was used as a soluble platinum compound with a platinum concentration of 0.5 g/L. The evaluations of the solution stability and the disturbance by the dry-film resist were both A. The thickness of the platinum plated coating after the submergence of the submerged base material was 0.05 μm.

Comparative Example 1

Comparative example 1 was the same as example 1 except that the pH was 10 by the pH adjuster. The evaluation of the solution stability was A, whereas the evaluation of the disturbance by the dry-film resist was C. The thickness of platinum plated coating after the submergence of the submerged base material was 0.01 μm.

Comparative Example 2

Comparative example 2 was the same as example 1 except that the concentration of KCl as the halide ion supplying agent was 0.5 g/L. The molar ratio of the addition of the halide ion supplying agent to the content of platinum was about 2.6. The evaluation of the solution stability was B, whereas the evaluation of the disturbance by the dry-film resist was A. The thickness of the platinum plated coating after the submergence of the submerged base material was 0.03 μm.

Comparative Example 3

Comparative example 3 was the same as example 1 except that 1 g/L hydrazine was used as a reducing agent, and the pH was 4 by the pH adjuster. The evaluation of the solution stability was C, whereas the evaluation of the disturbance by the dry-film resist was A. The thickness of the platinum plated coating after the submergence of the submerged base material was 0.05 μm.

Comparative Example 4

Comparative example 4 was the same as comparative example 3 except that the pH was 10 by the pH adjuster. The evaluations of the solution stability and the disturbance by the dry-film resist were both C. The thickness of the platinum plated coating after the submergence of the submerged base material was 0.01 μm.

Comparative Example 5

Comparative example 5 was the same as comparative example 4 except that 1 g/L sodium borohydride was used as a reducing agent. The evaluations of the solution stability and the disturbance by the dry-film resist were both C. The thickness of the platinum plated coating after the submergence of the submerged base material was 0.01 μm.

Table 1 shows the composition of the plating solution and the evaluation result in each example and each comparative example. Using formic acid as the reducing agent and adding the halide ion supplying agent can provide an electroless platinum plating solution that is sufficiently stable and available under acidic to weak alkaline conditions.

TABLE 1

| | | EXAMPLE 1 | EXAMPLE 2 | EXAMPLE 3 | EXAMPLE 4 | EXAMPLE 5 | EXAMPLE 6 | EXAMPLE 7 | EXAMPLE 8 |
|---|---|---|---|---|---|---|---|---|---|
| SOLUBLE PLATINUM COMPOUND | $K_2PtCl_4$ (g/L as Pt) | 0.5 | 0.5 | 0.5 | 0.5 | 0.5 | | | |
| | $Pt(NH_3)_4Cl_2$ (g/L as Pt) | | | | | | 0.5 | | |
| | $Pt(NH_3)_4(OH)_2$ (g/L as Pt) | | | | | | | 0.5 | |
| | $Pt(NO_2)_2(NH_3)_2$ (g/L as Pt) | | | | | | | | 0.5 |
| HALIDE ION SUPLLYING AGENT | KCl (g/L) | 50 | 5 | 50 | | | 50 | 50 | 50 |
| | KI (g/L) | | | | 50 | | | | |
| | KBr (g/L) | | | | | 50 | | | |
| REDUCING AGENT | POTASSIUM FORMATE (g/L) | 10 | 10 | 10 | 10 | 10 | 10 | 10 | 10 |
| | HYDRAZINE (g/L) | | | | | | | | |
| | SODIUM BOROHYDRIDE (g/L) | | | | | | | | |
| COMPLEXING AGENT | EDTA (g/L) | 10 | 10 | 10 | 10 | 10 | 10 | 10 | 10 |
| BUFFER | POTASSIUM DIHYDROGEN-PHOSPHATE (g/L) | 10 | 10 | 10 | 10 | 10 | 10 | 10 | 10 |
| | pH | 7 | 7 | 4 | 7 | 7 | 7 | 7 | 7 |
| SOLUTION STABILITY | | A | A | A | A | A | A | A | A |
| EFFECT OF DFR | | A | A | A | A | A | A | A | A |
| THICKNESS (μm) | | 0.05 | 0.04 | 0.05 | 0.05 | 0.05 | 0.05 | 0.05 | 0.05 |

| | | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|---|
| SOLUBLE PLATINUM COMPOUND | $K_2PtCl_4$ (g/L as Pt) | 0.5 | 0.5 | 0.5 | 0.5 | 0.5 |
| | $Pt(NH_3)_4Cl_2$ (g/L as Pt) | | | | | |
| | $Pt(NH_3)_4(OH)_2$ (g/L as Pt) | | | | | |
| | $Pt(NO_2)_2(NH_3)_2$ (g/L as Pt) | | | | | |
| HALIDE ION SUPLLYING AGENT | KCl (g/L) | 50 | 0.5 | 50 | 50 | 50 |
| | KI (g/L) | | | | | |
| | KBr (g/L) | | | | | |
| REDUCING AGENT | POTASSIUM FORMATE (g/L) | 10 | 10 | | | |
| | HYDRAZINE (g/L) | | | 1 | 1 | |
| | SODIUM BOROHYDRIDE (g/L) | | | | | 1 |
| COMPLEXING AGENT | EDTA (g/L) | 10 | 10 | 10 | 10 | 10 |
| BUFFER | POTASSIUM DIHYDROGEN-PHOSPHATE (g/L) | 10 | 10 | 10 | 10 | 10 |
| | pH | 10 | 7 | 4 | 10 | 10 |
| SOLUTION STABILITY | | A | B | C | C | C |
| EFFECT OF DFR | | C | A | A | C | C |
| THICKNESS (μm) | | 0.01 | 0.03 | 0.05 | 0.01 | 0.01 |

INDUSTRIAL APPLICABILITY

An electroless platinum plating solution of the present disclosure is sufficiently stable, and is particularly useful as an electroless platinum plating solution for forming a platinum coating for use in electric components.

What is claimed is:

1. An electroless platinum plating solution comprising:

a soluble platinum compound, a complexing agent, a reducing agent, and a halide ion supplying agent, the reducing agent being formic acid, wherein the halide ion supplying agent is an alkali metal halide.

2. The electroless platinum plating solution of claim 1, wherein the halide ion supplying agent is included at a molar ratio of 10 or more with respect to platinum.

3. The electroless platinum plating solution of claim 2, wherein the halide ion supplying agent is included at the molar ratio of 500 or less with respect to platinum.

4. The electroless platinum plating solution of claim 1, wherein the alkali metal halide is at least one of sodium chloride, potassium chloride, sodium iodide, potassium iodide, sodium bromide, or potassium bromide.

5. The electroless platinum plating solution of claim 1, wherein the electroless platinum plating solution has a pH of 9 or less.

6. The electroless platinum plating solution of claim 1, wherein the soluble platinum compound is one of dinitrodiammine platinum, chloroplatinate, tetraammine platinum salt, and hexaammine platinum salt.

7. A method for manufacturing a platinum coating on a target by submerging the target into the electroless platinum plating solution of claim 1.

* * * * *